US012653309B2

(12) United States Patent
Chen et al.

(10) Patent No.: US 12,653,309 B2
(45) Date of Patent: Jun. 16, 2026

(54) SLIDE RAIL ASSEMBLY

(71) Applicants: King Slide Works Co., Ltd., Kaohsiung City (TW); King Slide Technology Co., Ltd., Kaohsiung City (TW)

(72) Inventors: Ken-Ching Chen, Kaohsiung City (TW); Shun-Ho Yang, Kaohsiung City (TW); Tzu-Cheng Weng, Kaohsiung City (TW); Chun-Chiang Wang, Kaohsiung City (TW)

(73) Assignees: King Slide Works Co., Ltd., Kaohsiung City (TW); King Slide Technology Co., Ltd., Kaohsiung City (TW)

( * ) Notice: Subject to any disclaimer, the term of this patent is extended or adjusted under 35 U.S.C. 154(b) by 74 days.

(21) Appl. No.: 18/823,454

(22) Filed: Sep. 3, 2024

(65) Prior Publication Data

US 2025/0204682 A1 Jun. 26, 2025

(30) Foreign Application Priority Data

Dec. 25, 2023 (TW) ..... 112150764

(51) Int. Cl.
*A47B 88/443* (2017.01)
*A47B 88/49* (2017.01)

(52) U.S. Cl.
CPC ..... *A47B 88/443* (2017.01); *A47B 88/49* (2017.01)

(58) Field of Classification Search
CPC ..... A47B 88/443; A47B 88/49; A47B 88/57; A47B 88/43; A47B 88/477; A47B 2210/0081; A47B 2088/4235; A47B 2210/007; H05K 7/1489; H05K 7/183
See application file for complete search history.

(56) References Cited

U.S. PATENT DOCUMENTS

| | | | | |
|---|---|---|---|---|
| 9,992,906 | B2 | 6/2018 | Chen et al. | |
| 10,041,535 | B2 | 8/2018 | Chen et al. | |
| 10,743,658 | B1 * | 8/2020 | Chen | A47B 88/447 |
| 10,888,158 | B1 * | 1/2021 | Chen | A47B 88/473 |
| 10,973,322 | B1 * | 4/2021 | Chen | A47B 88/493 |
| 11,076,694 | B2 | 8/2021 | Chen et al. | |
| 2017/0188705 | A1 * | 7/2017 | Chen | H05K 7/1489 |
| 2018/0031037 | A1 * | 2/2018 | Chen | F16C 29/10 |
| 2018/0070723 | A1 * | 3/2018 | Chen | F16C 29/04 |
| 2018/0092462 | A1 * | 4/2018 | Chen | A47B 88/493 |
| 2018/0317652 | A1 * | 11/2018 | Chen | A47B 88/49 |

(Continued)

FOREIGN PATENT DOCUMENTS

| | | | |
|---|---|---|---|
| EP | 3275338 | A1 | 1/2018 |
| GB | 2434081 | A | 7/2007 |
| JP | 2021-079073 | A | 5/2021 |

*Primary Examiner* — Hiwot E Tefera
(74) *Attorney, Agent, or Firm* — Best & Flanagan LLP

(57) ABSTRACT

A slide rail assembly includes a first rail, a second rail, a third rail and a switching member movable between a first state and a second state. The third rail is movably mounted between the first rail and the second rail. When the second rail is moved along a predetermined direction relative to the third rail located at a predetermined position relative to the first rail, the switching member is configured to abut against a predetermined part of the third rail, in order to move the switching member to switch from the second state to the first state.

19 Claims, 14 Drawing Sheets

(56) References Cited

U.S. PATENT DOCUMENTS

| | | | | |
|---|---|---|---|---|
| 2019/0200756 | A1* | 7/2019 | Chen | A47B 88/473 |
| 2019/0274428 | A1* | 9/2019 | Chen | H05K 7/1489 |
| 2020/0107636 | A1* | 4/2020 | Chen | H05K 7/183 |
| 2020/0214444 | A1* | 7/2020 | Chen | A47B 88/473 |
| 2021/0120951 | A1* | 4/2021 | Chen | A47B 88/57 |
| 2021/0145173 | A1* | 5/2021 | Chen | H05K 7/1489 |
| 2022/0065292 | A1* | 3/2022 | Chen | A47B 88/44 |
| 2022/0192376 | A1* | 6/2022 | Chen | A47B 88/57 |
| 2024/0215720 | A1* | 7/2024 | Chen | F16C 29/02 |
| 2025/0204682 | A1* | 6/2025 | Chen | A47B 88/57 |

* cited by examiner

SLIDE RAIL ASSEMBLY

BACKGROUND OF THE INVENTION

1. Field of the Invention

The present invention relates to a slide rail assembly, and more particularly, to a slide rail assembly comprising a switching member capable of returning to an initial position through relative movement between slide rails.

2. Description of the Prior Art

U.S. Pat. No. 9,992,906 B2 discloses a slide rail assembly comprising a first rail, a second rail, a third rail, a first engaging mechanism and a switching member. The second rail is movably mounted between the first rail and the third rail. The first engaging mechanism is arranged on the second rail, and the switching member is arranged on the third rail. The switching member is configured to be operated to move between a first switching position and a second switching position. When the third rail is moved from a third position (such as a fully extended position) along a second direction (such as a retracting direction), the switching member at the second switching position is configured to push the second rail back from a second position (such as fully open position) to a fourth position, so as to shorten a length of the slide rail assembly. Moreover, the first engaging mechanism and a first stopping member on the first rail are configured to block each other to prevent the second rail from being moved along a first direction (such as an opening direction) from the fourth position.

The switching member in the aforementioned patent is required to be directly manually operated by a user to return to the first switching position from the second switching position. However, for different market requirements, it is important to develop various products for the user.

SUMMARY OF THE INVENTION

The present invention provides a slide rail assembly comprising a switching member capable of returning to an initial position through relative movement between slide rails.

According to an embodiment of the present invention, a slide rail assembly comprises a first rail, a second rail, a third rail and a switching member. The first rail is arranged with an auxiliary structure. The third rail is movably mounted between the first rail and the second rail and arranged with a predetermined part and an engaging member. The predetermined part has a first predetermined section and a second predetermined section. The switching member is movable relative to the second rail, and comprises a first contact part and a second contact part. When the third rail is located at a first predetermined position relative to the first rail and the second rail is located at a second predetermined position relative to the third rail, the slide rail assembly has a first predetermined length. During a process of the switching member being moved to switch from a first state to a second state with the second rail being moved from the second predetermined position along a retracting direction, the first contact part of the switching member in the second state and the first predetermined section of the predetermined part are configured to abut against each other, such that the second rail is configured to drive the third rail to move along the retracting direction to a third predetermined position. When the third rail is located at the third predetermined position relative to the first rail, the engaging member is configured to be engaged with the auxiliary structure in order to prevent the third rail from being moved along an opening direction, and the slide rail assembly has a second predetermined length shorter than the first predetermined length. During a process of the second rail being moved along the opening direction relative to the third rail located at the third predetermined position, the second contact part of the switching member and the second predetermined section of the predetermined part are configured to abut against each other in order to drive the switching member to return from the second state to the first state.

According to another embodiment of the present invention, a slide rail assembly comprises a first rail, a second rail, a third rail and a switching member. The second rail is longitudinally movable relative to the first rail. The third rail is movably mounted between the first rail and the second rail and arranged with a predetermined part. The predetermined part has a first predetermined section and a second predetermined section. The switching member is movably mounted on the second rail and configured to be in one of a first state and a second state. The switching member comprises a first contact part and a second contact part. When the switching member is in the first state, the first contact part of the switching member is not aligned with the predetermined part along a longitudinal direction of the slide rail assembly. When the switching member is in the second state, the first contact part of the switching member is aligned with the predetermined part along the longitudinal direction. When the slide rail assembly is in an extended state, the third rail is located at a first predetermined position relative to the first rail, and the second rail is located at a second predetermined position relative to the third rail. During a process of the second rail being moved from the second predetermined position along a retracting direction with the switching member being in the second state, the first contact part of the switching member in the second state and the first predetermined section of the predetermined part are configured to abut against each other, such that the second rail is configured to drive the third rail to move along the retracting direction to a third predetermined position. During a process of the second rail being moved along an opening direction relative to the third rail located at the third predetermined position, the second contact part of the switching member and the second predetermined section of the predetermined part are configured to abut against each other in order to move the switching member to switch from the second state to the first state.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
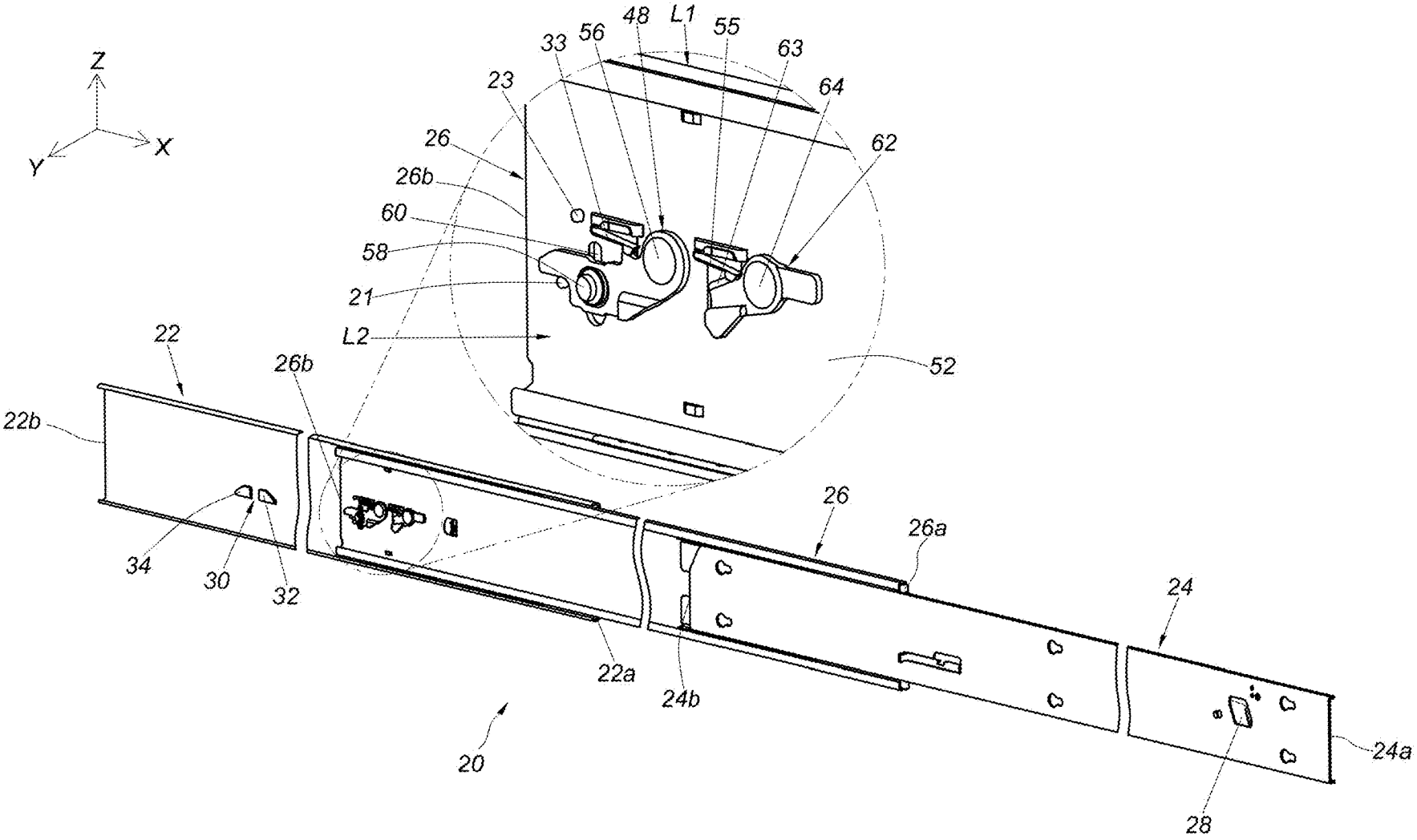
FIG. 1 is a diagram showing a slide rail assembly according to an embodiment of the present invention.
Figure 2:
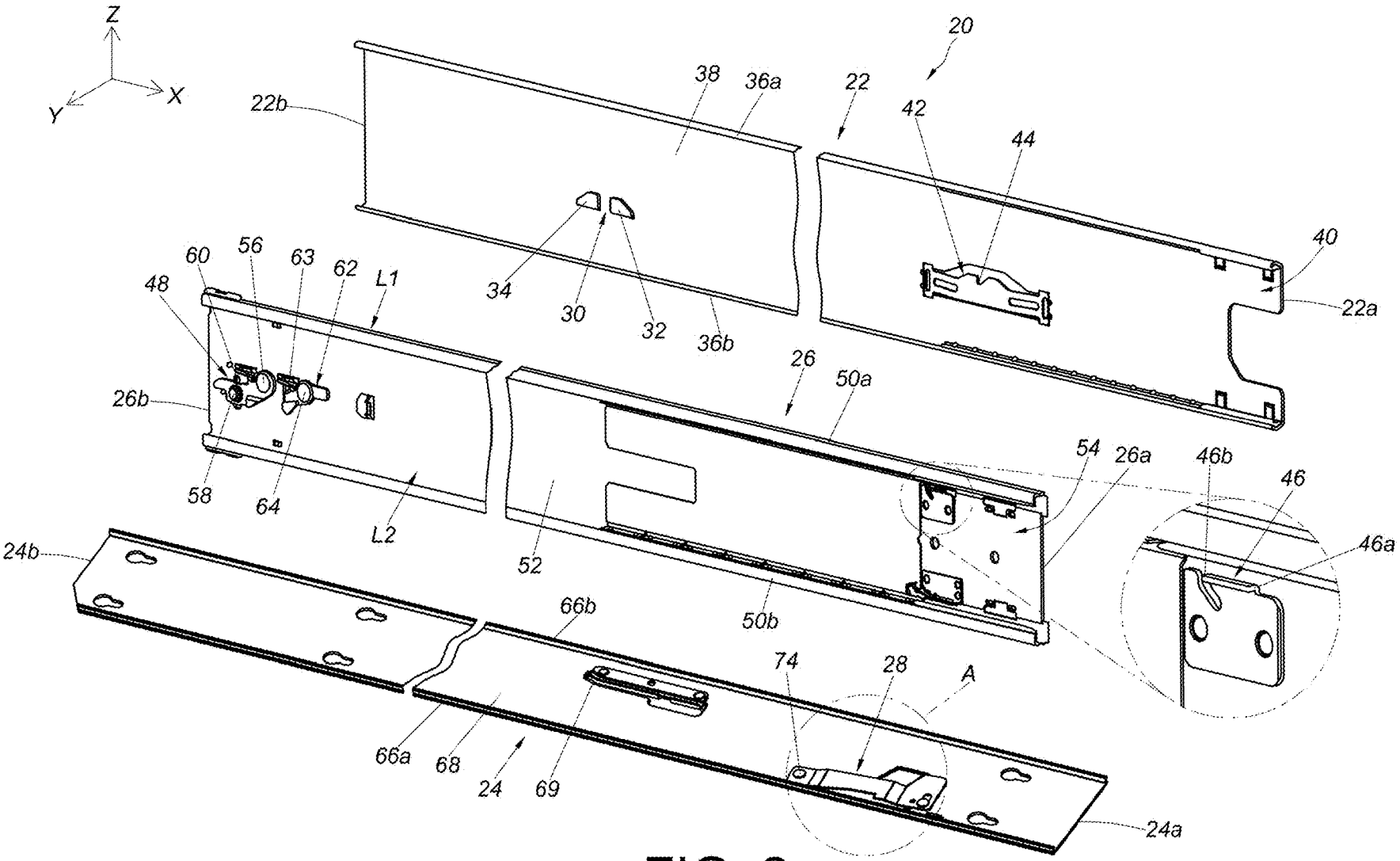
FIG. 2 is an exploded view of the slide rail assembly comprising a first rail, a second rail and a third rail according to the embodiment of the present invention.

As shown in FIG. 1 and FIG. 2, a slide rail assembly 20 comprises a first rail 22, a second rail 24, a third rail 26 and a switching member 28 according to an embodiment of the present invention. The third rail 26 is movably mounted between the first rail 22 and the second rail 24. The first rail 22, the second rail 24 and the third rail 26 are longitudinally movable relative to each other. In the present embodiment, the X axis is a longitudinal direction (or a length direction or moving direction of the slide rail), the Y axis is a transverse direction (or a lateral direction of the slide rail), and the Z axis is a vertical direction (or a height direction of the slide rail.

The first rail 22 is arranged with an auxiliary structure 30. In the present embodiment, the auxiliary structure 30 comprises a first auxiliary part 32. Preferably, the auxiliary structure 30 further comprises a second auxiliary part 34. Moreover, the first rail 22 has a first end part 22*a* and a second end part 22*b* opposite to each other, such as a front end part and a rear end part, but the present invention is not limited thereto. The first rail 22 comprises a first wall 36*a*, a second wall 36*b* and a longitudinal wall 38 connected between the first wall 36*a* and the second wall 36*b* of the first rail 22. A first passage 40 is defined by the first wall 36*a*, the second wall 36*b* and the longitudinal wall 38 of the first rail 22, and configured to accommodate the third rail 26.

Preferably, the auxiliary structure 30 is arranged on the longitudinal wall 38 of the first rail 22, and the auxiliary structure 30 is adjacent to the second end part 22*b* of the first rail 22. The first auxiliary part 32 and the second auxiliary part 34 of the auxiliary structure 30 are protrusions, but the present invention is not limited thereto.

Preferably, the first rail 22 is further arranged with a blocking structure 42 on the longitudinal wall 38 of the first rail 22. The blocking structure 42 is adjacent to the first end part 22*a* of the first rail 22, and the blocking structure 42 comprises a blocking section 44. The blocking structure 42 is an additional component attached to the first rail 22, and the blocking structure 42 is protruded relative to the longitudinal wall 38 of the first rail 22. In other alternative embodiment, the blocking structure 42 can be directly integrated to the first rail 22. Therefore, the present invention is not limited thereto.

The third rail 26 is arranged with a predetermined part 46 and an engaging member 48. The predetermined part 46 has a first predetermined section 46*a* and a second predetermined section 46*b* opposite to each other, such as a front section and a rear section, but the present invention is not limited thereto. The predetermined part 46 can be a protruded structure directly or indirectly mounted to the third rail 26. Furthermore, the third rail 26 has a first end part 26*a* and a second end part 26*b* opposite to each other, such as a front end part and a rear end part, but the present invention is not limited thereto. The third rail 26 comprises a first wall 50*a*, a second wall 50*b* and a longitudinal wall 52 connected between the first wall 50*a* and the second wall 50*b* of the third rail 26. A second passage 54 is defined by the first wall 50*a*, the second wall 50*b* and the longitudinal wall 52 of the third rail 26, and configured to accommodate the second rail 24.

Preferably, the predetermined part 46 is arranged on the longitudinal wall 52 of the third rail 26, and the predetermined part 46 is located adjacent to the first end part 26*a* of the third rail 26.

Preferably, the engaging member 48 is movably mounted on the third rail 26. For example, the engaging member 48 is pivotally connected to the longitudinal wall 52 of the third rail 26 through a first shaft part 56, and the engaging member 48 is located adjacent to the second end part 26*b* of the third rail 26.

Preferably, the engaging member 48 comprises an engaging part 58, and the longitudinal wall 52 of the third rail 26 is formed with an elongated hole 60 communicating a first side L1 and a second side L2 of the longitudinal wall 52 of the third rail 26. The first side L1 (such as an outer side) of the third rail 26 is adjacent to the first rail 22, and the second side L2 (such as an inner side) of the third rail 26 is adjacent to the second rail 24. The engaging member 48 is movably mounted on the second side L2 of the third rail 26, and the engaging part 58 of the engaging member 48 passes through the elongated hole 60 from the second side L2 to the first side L1 of the third rail 26 in order to interact with the auxiliary structure 30 of the first rail 22.

Preferably, the third rail 26 is further arranged with a blocking member 62, and the blocking member 62 is movably mounted on the third rail 26. For example, the blocking member 62 is pivotally connected to the longitudinal wall 52 of the third rail 26 through a second shaft part 64. The blocking member 62 is located adjacent to the engaging member 48, and the blocking member 62 and the engaging member 48 are separated from each other by a predetermined longitudinal distance along the longitudinal direction. A blocking part 63 of the blocking member 62 is extended from the second side L2 to the first side L1 of the third rail 26 in order to interact with the blocking structure 42 of the first rail 22.

Preferably, the blocking member 62 is farther away from the second end part 26*b* of the third rail 26 than the engaging member 48.

Preferably, the slide rail assembly 20 further comprises a first elastic member 33 configured to provide an elastic force to the engaging member 48, and a second elastic member 55 configured to provide an elastic force to the blocking member 62 (as shown in FIG. 1).

Preferably, the longitudinal wall 52 of the third rail 26 is further arranged with a first limiting part 21 and a second limiting part 23 (as shown in FIG. 1) configured to limit a moving range of the engaging member 48. The first limiting part 21 and the second limiting part 23 are protrusions, but the present invention is not limited thereto.

The second rail 24 has a first end part 24*a* and a second end part 24*b* opposite to each other, such as a front end part and a rear end part, but the present invention is not limited thereto. The second rail 24 comprises a first wall 66*a*, a second wall 66*b* and a longitudinal wall 68 connected between the first wall 66*a* and the second wall 66*b* of the second rail 24.

Preferably, the second rail 24 is arranged with a predetermined feature 69. The predetermined feature 69 has an inclined surface or an art surface. The predetermined feature 69 can be directly formed on the second rail 24, or the predetermined feature 69 can be formed on an additional connecting component which is mounted to the second rail 24, but the present invention is not limited thereto.

Figure 3:
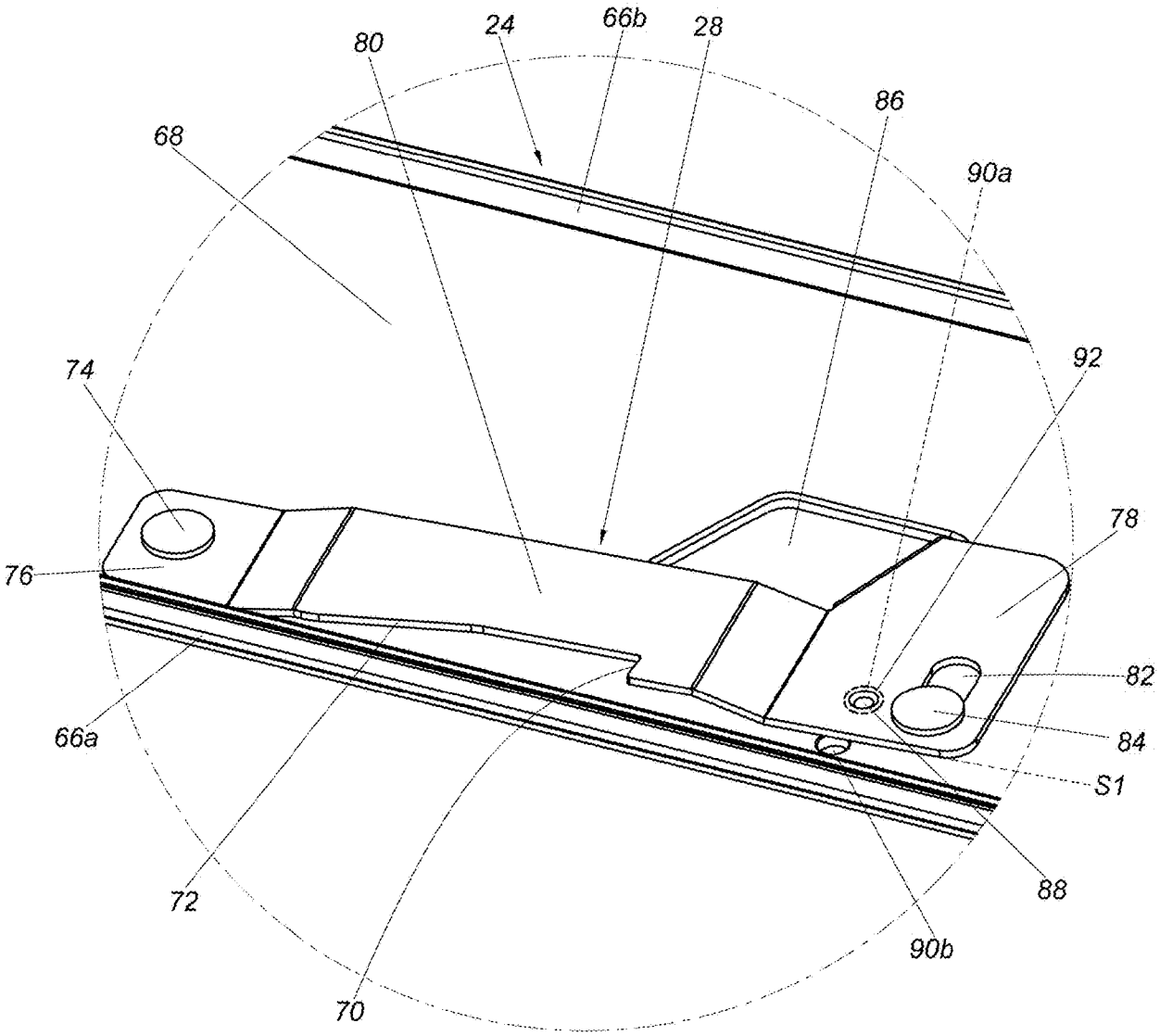
FIG. 3 is an enlarged view of an area A of FIG. 2.
Figure 4:
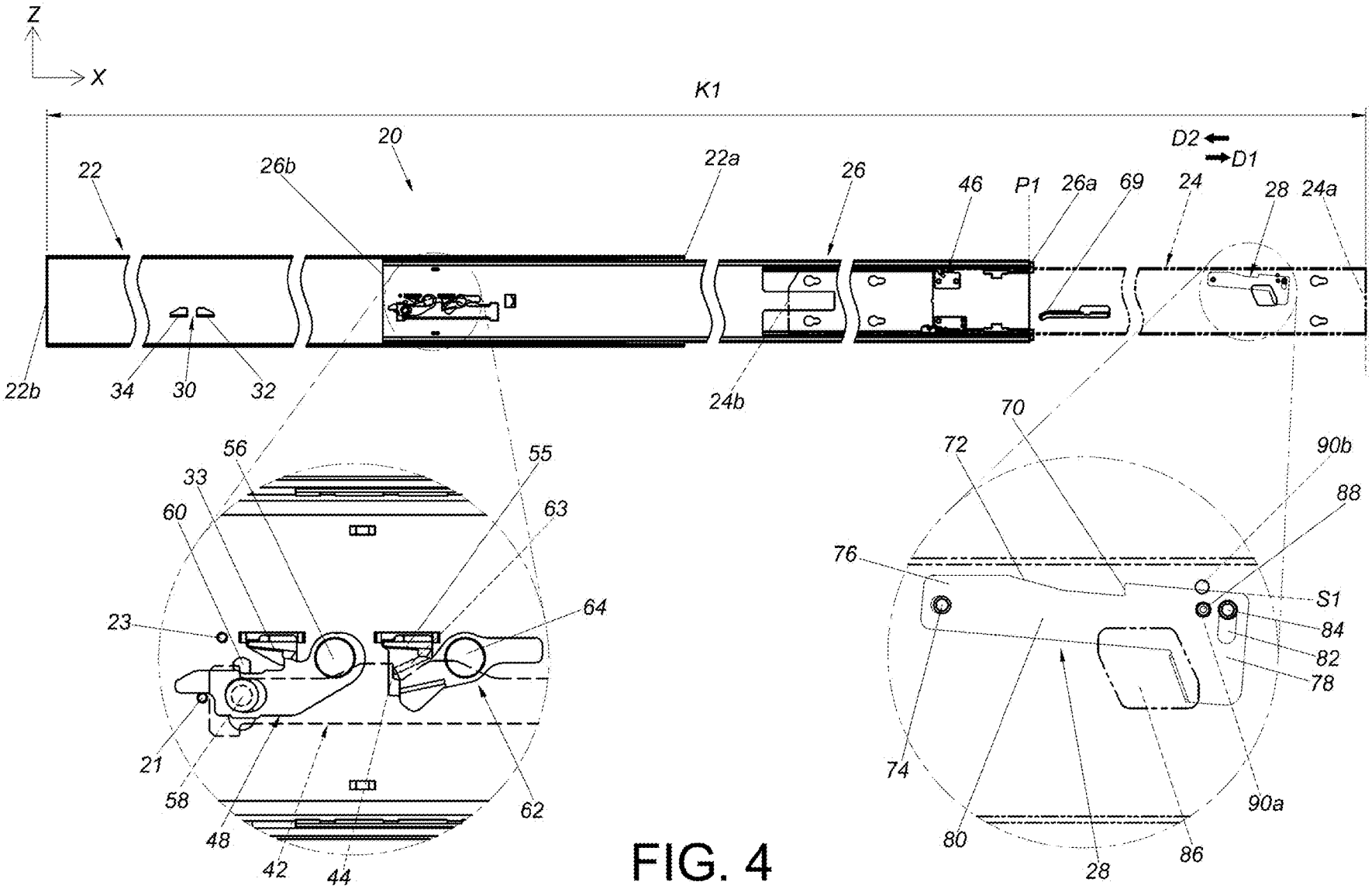
FIG. 4 is a diagram showing the slide rail assembly being in an extended state and having a first predetermined length with a switching member being in a first state according to the embodiment of the present invention.

As shown in FIG. 2 and FIG. 3, the switching member 28 comprises a first contact part 70 and a second contact part 72. Preferably, the switching member 28 is movable relative to the second rail 24 to be in a first state S1 (as shown in FIG. 3 and FIG. 4) or a second state S2 (please refer to FIG. 5). In the present embodiment, the switching member 28 is movably mounted on the second rail 24. Specifically, the switching member 28 is pivotally connected to the longitudinal wall 68 of the second rail 24 through a shaft member 74.

Preferably, the switching member 28 comprises a first part 76, a second part 78 and an extension part 80 connected between the first part 76 and the second part 78. The first part 76 is pivotally connected to the longitudinal wall 68 of the second rail 24 through the shaft member 74, and the extension part 80 comprises the first contact part 70 and the second contact part 72 (as shown in FIG. 3).

Preferably, one of the second part 78 of the switching member 28 and the second rail 24 is arranged with a first limiting feature 82, and the other one of the second part 78 of the switching member 28 and the second rail 24 is arranged with a second limiting feature 84.

Preferably, one of the first limiting feature 82 and the second limiting feature 84 is formed with a limiting space, and the other one of the first limiting feature 82 and the second limiting feature 84 is formed with a protruding part (such as a pin, a nail or the like) passing through a portion of the limiting space.

Preferably, the switching member 28 is located adjacent to the first end part 24*a* of the second rail 24.

Preferably, the second rail 24 is further formed with a through hole 86 to allow a user to easily operate the switching member 28. For example, the user can insert a finger into the through hole 86 to apply a force to the switching member 28 in order to move the switching member 28 to switch from the first state S1 to the second state S2.

Preferably, one of the switching member 28 and the second rail 24 comprises a holding feature 88. In the present embodiment, the switching member 28 comprises the holding feature 88. The other one of the switching member 28 and the second rail 24 comprises a plurality of corresponding features. In the present embodiment, the second rail 24 comprises a first corresponding feature 90*a* and a second corresponding feature 90*b* (as shown in FIG. 3). When the switching member 28 is in the first state S1, the holding feature 88 is configured to be detachably engaged with the first corresponding feature 90*a* in order to temporarily hold the switching member 28 in the first state S1 (as shown in FIG. 3 and FIG. 4). When the switching member 28 is in the second state S2, the holding feature 88 is configured to be detachably engaged with the second corresponding feature 90*b* in order to temporarily hold the switching member 28 in the second state S2 (please refer to FIG. 5).

Preferably, the holding feature 88 and the corresponding feature are a combination of a convex feature and a concave feature (or hole) interacting with each other. For example, the holding feature 88 can be a convex feature, and the first corresponding feature 90*a* and the second corresponding feature 90*b* are concave features (or holes) configured to be engaged with the convex feature.

Preferably, the holding feature 88 and/or the corresponding feature has a guiding feature 92 (as shown in FIG. 3), such as an arc surface or an inclined surface. For example, the holding feature 88 has the guiding feature 92, such that the holding feature 88 can be easily detached from the first corresponding feature 90*a* or the second corresponding feature 90*b*.

As shown in FIG. 4, the slide rail assembly 20 is in a fully extended state. The first rail 22 is configured to be mounted to a rack (or a cabinet), and the second rail is configured to carry a carried object. When the slide rail assembly 20 is in the fully extended state, the third rail 26 is located at a first predetermined position P1 relative to the first rail 22, and the second rail 24 is located at a second predetermined position P2 relative to the third rail 26. In such state, the slide rail assembly 20 has a first predetermined length K1. Specifically, the first predetermined length K1 is defined between the first end part 24*a* of the second rail 24 and the second end part 22*b* of the first rail 22.

Preferably, when the third rail 26 is located at the first predetermined position P1 relative to the first rail 22, the blocking part 63 of the blocking member 62 and the blocking section 44 of the blocking structure 42 are configured to block each other in order to prevent the third rail 26 from being moved relative to the first rail 22 from the first predetermined position P1 along a retracting direction D2. On the other hand, when the second rail 24 is located at the second predetermined position P2 relative to the third rail 26, the second rail 24 can be detachably held at the second predetermined position P2 through a positioning mechanism (not shown in figures). Once the positioning mechanism is disabled, the second rail 24 can be moved away from the second predetermined position P2 relative to the third rail 26 along an opening direction D1 or the retracting direction D2. Such configuration is well known to those skilled in the art, no further illustration is provided for simplification.

Moreover, when the slide rail assembly 20 is applied in a narrow space and when the slide rail assembly 20 is in the fully extended state with the first end part 24*a* of the second rail 24 being adjacent to an obstacle (not shown in figures), it is not easy to further move the second rail 24 from the second predetermined position P2 along the opening direction D1 relative to the third rail 26 to detach the second rail 24 from the third rail 26. In such state, the user may move the third rail 26 from the first predetermined position P1 along the retracting direction D2 to a predetermined position, such that the overall length of the slide rail assembly 20 is shortened, so as to allow the second rail 24 to be easily detached from the third rail 26 along the opening direction D1.

Figure 5:
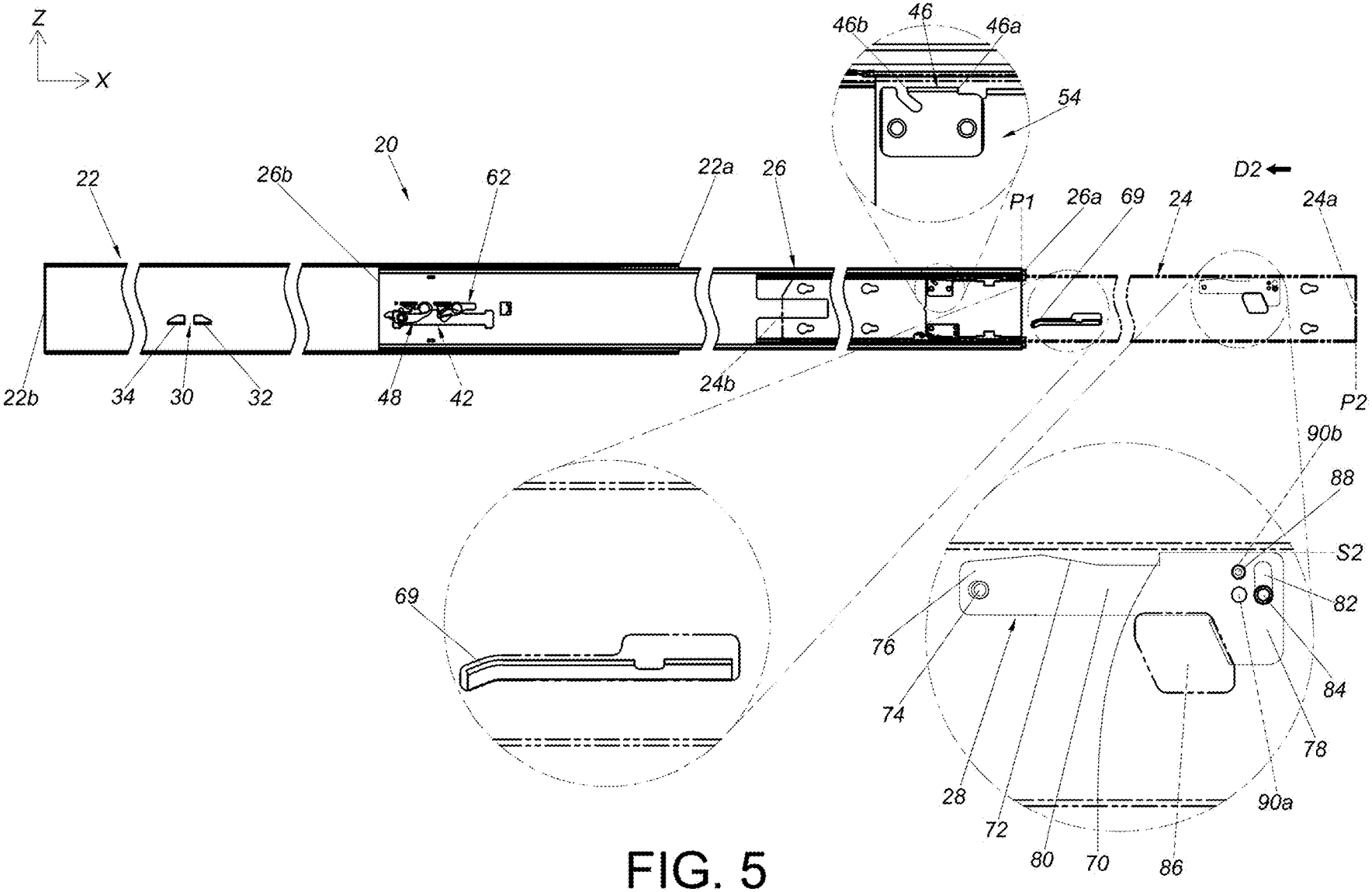
FIG. 5 is a diagram showing the slide rail assembly being in the extended state with the switching member being in a second state according to the embodiment of the present invention.
Figure 6:
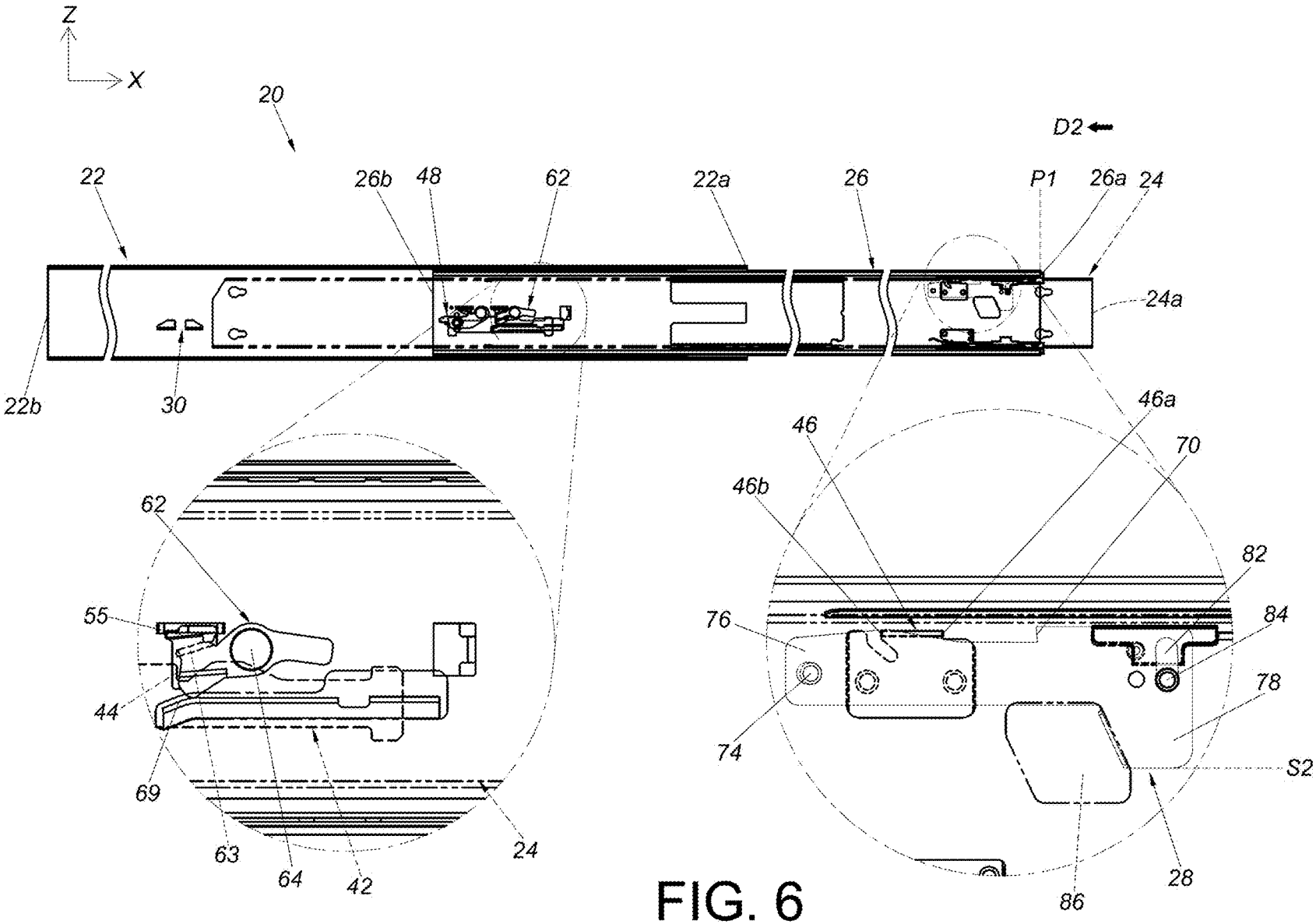
FIG. 6 is a diagram showing the second rail being moved along a retracting direction to disable blocking configuration between the third rail and the first rail according to the embodiment of the present invention.

As shown in FIG. 4 to FIG. 6, the switching member 28 is operated by the user to move from the first state S1 (as shown in FIG. 4) to the second state S2 (as shown in FIG. 5 and FIG. 6). When the switching member 28 is in the first state S1, the first contact part 70 of the switching member 28 is not aligned with the predetermined part 46 (the first predetermined section 46*a* of the predetermined part 46) along the longitudinal direction of the slide rail assembly 20. When the switching member 28 is in the second state S2, the first contact part 70 of the switching member 28 is aligned with the predetermined part 46 (the first predetermined section 46*a* of the predetermined part 46) along the longitudinal direction of the slide rail assembly 20.

Furthermore, during a process of the second rail 24 being moved from the second predetermined position P2 along the retracting direction D2, the predetermined feature 69 on the second rail 24 is configured to drive the blocking member 62 to move (for example, the blocking member 62 is rotated a predetermined angle), such that the blocking part 63 of the blocking member 62 is apart from the blocking section 44 of the blocking structure 42. Therefore, the blocking part 63 of the blocking member 62 and the blocking section 44 of the blocking structure 42 no longer block each other, so as to allow the third rail 26 to be moved relative to the first rail 22 from the first predetermined position P1 along the retracting direction D2 (as shown in FIG. 6).

Figure 7:
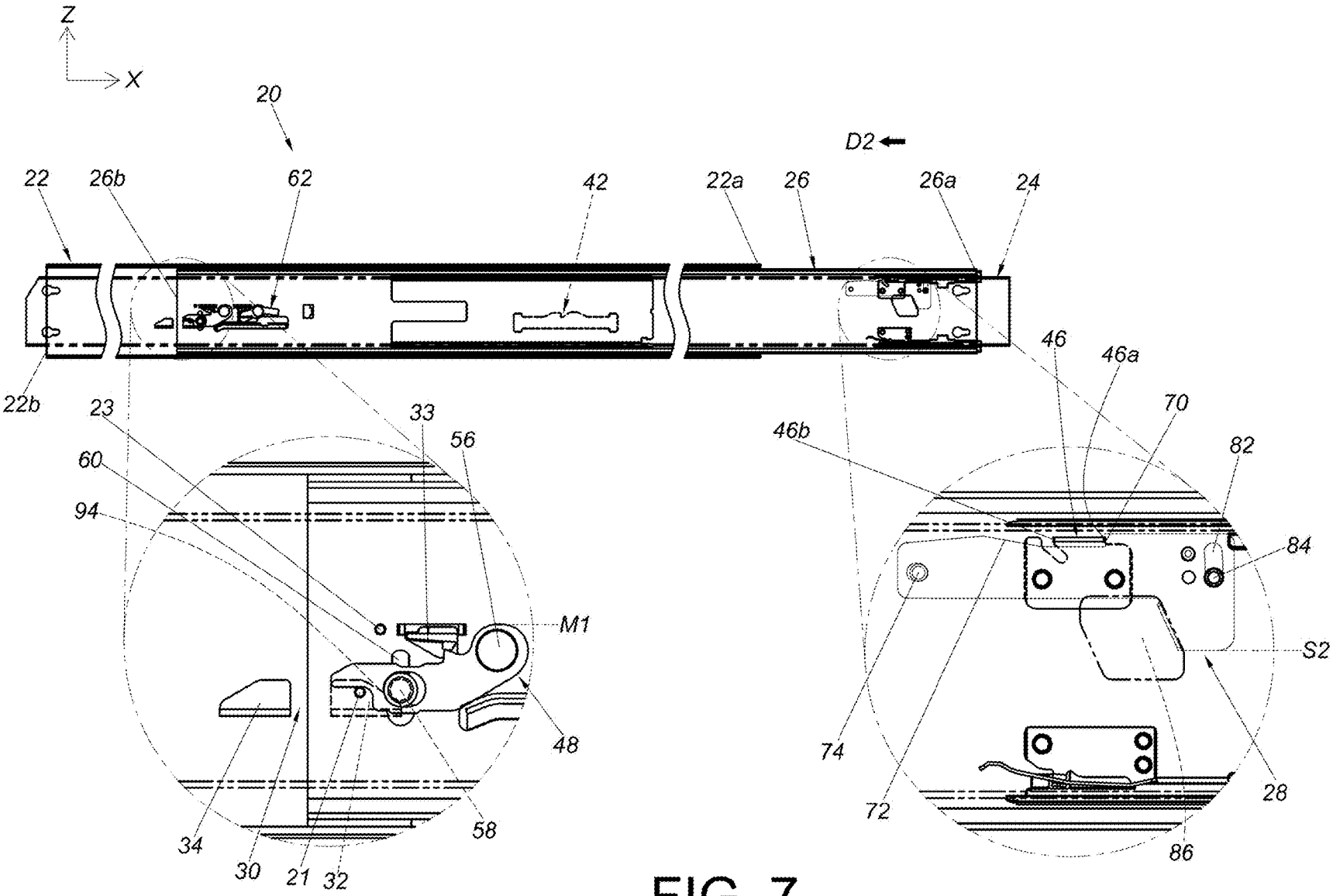
FIG. 7 is a diagram showing the second rail and the third rail being synchronously moved relative to the first rail along the retracting direction according to the embodiment of the present invention.
Figure 8:
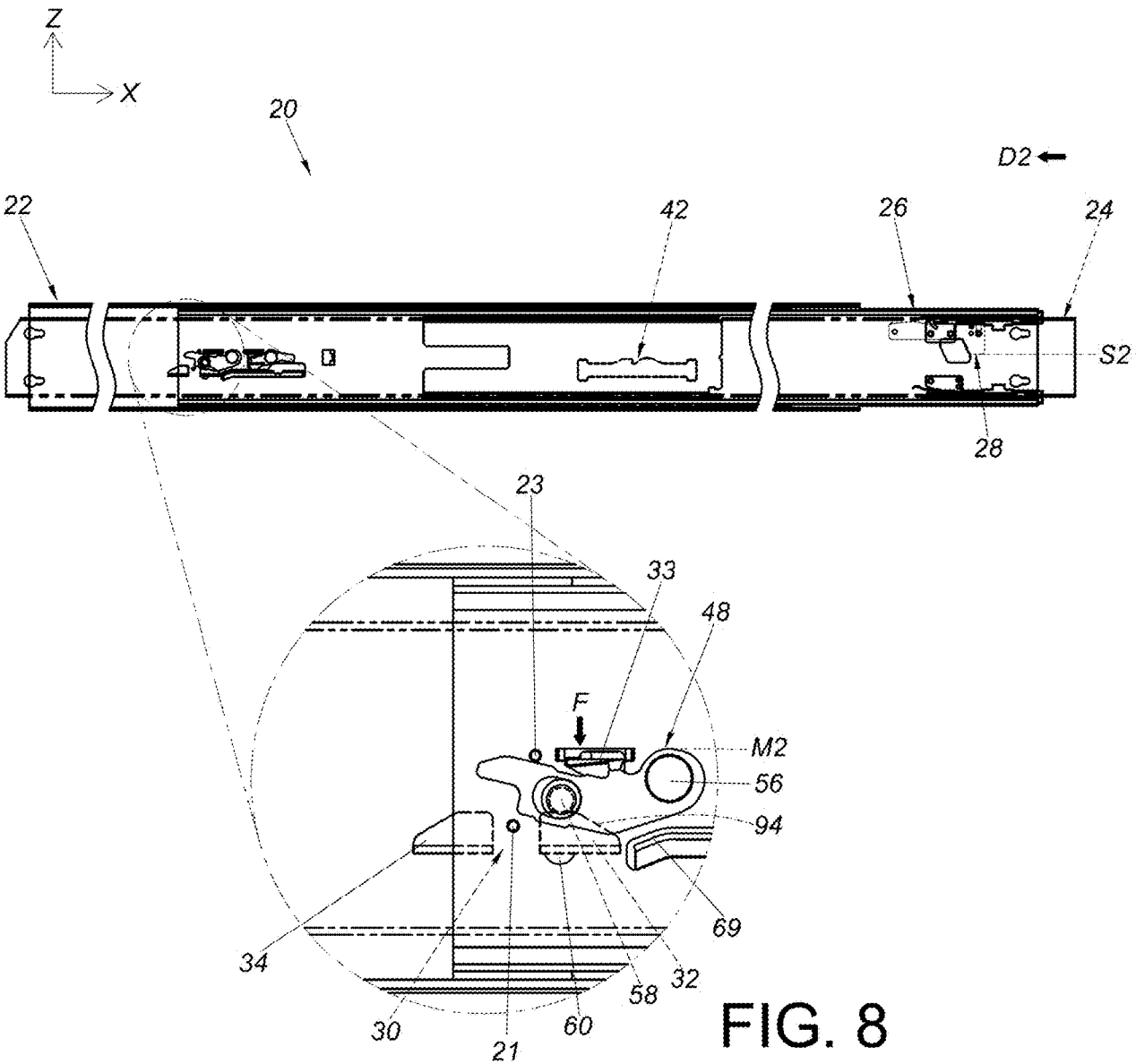
FIG. 8 is a diagram showing the second rail and the third rail being further synchronously moved relative to the first rail along the retracting direction according to the embodiment of the present invention.
Figure 9:
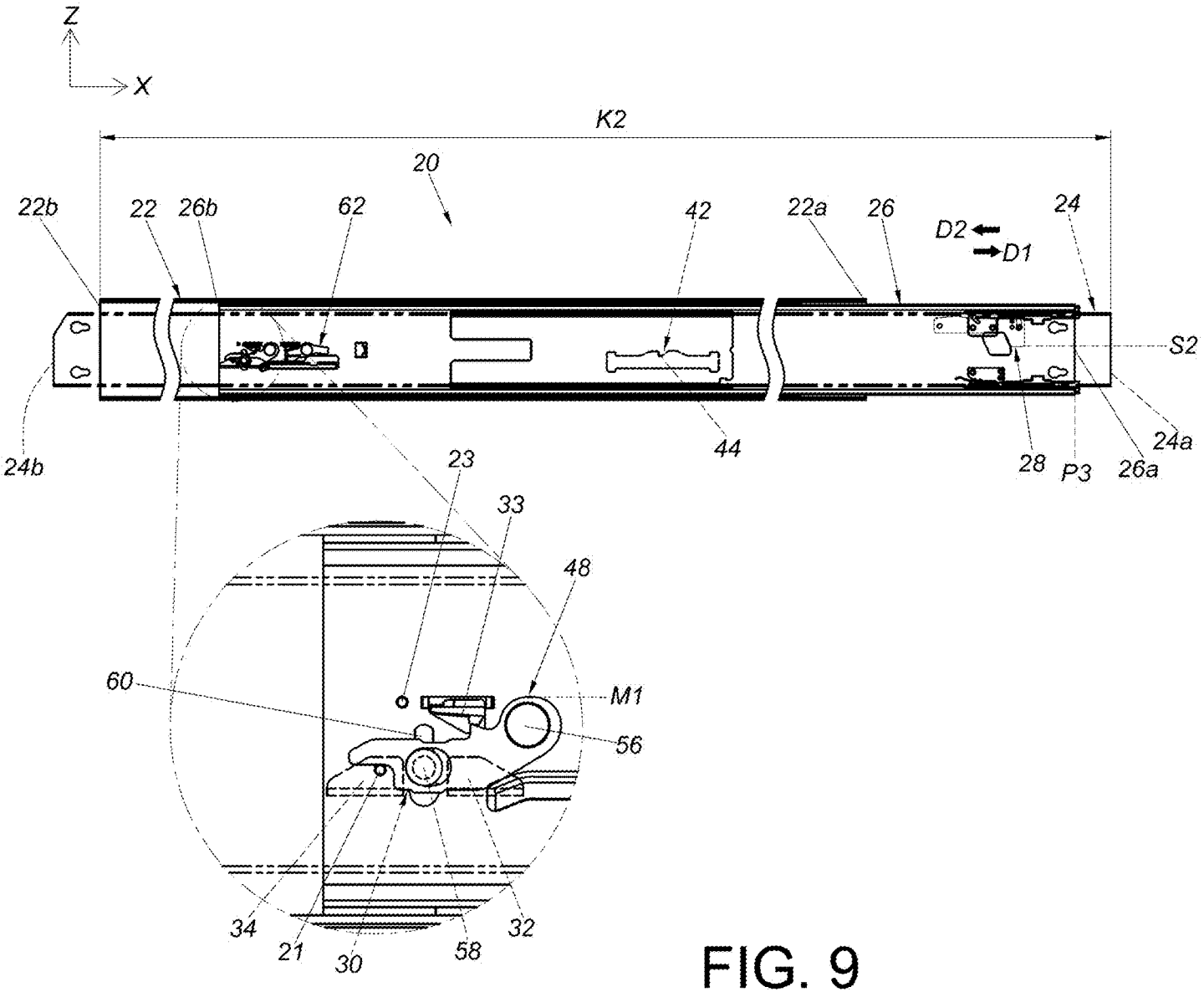
FIG. 9 is a diagram showing the third rail being driven to move to a predetermined position relative to the first rail by the second rail to allow the slide rail assembly to have a second predetermined length according to the embodiment of the present invention.

As shown in FIG. 7 to FIG. 9, during the process of the second rail 24 being further moved along the retracting direction D2, the first contact part 70 of the switching member 28 in the second state S2 and the first predetermined section 46*a* of the predetermined part 46 are configured to abut against each other (as shown in FIG. 7), such that the second rail 24 is configured to drive the third rail 26 to move along the retracting direction D2 (as shown in FIG. 8). Therefore, the second rail 24 and the third rail 26 are configured to be synchronously moved along the retracting direction D2 until the third rail 26 reaches a third predetermined position P3 (as shown in FIG. 9). Moreover, during such process, the second contact part 72 of the switching member 28 is adjacent to the second predetermined section 46*b* of the predetermined part 46, and the second contact part 72 of the switching member 28 is extended beyond the second predetermined section 46*b* of the predetermined part 46 along the retracting direction D2 (as shown in FIG. 7).

Preferably, one of the engaging part 58 of the engaging member 48 and the first auxiliary part 32 of the auxiliary structure 30 has a guiding section 94. In the present embodiment, the first auxiliary part 32 of the auxiliary structure 30 has the guiding section 94 (as shown in FIG. 7 and FIG. 8). During the process of the second rail 24 and the third rail 26 being synchronously moved along the retracting direction D2, the engaging part 58 of the engaging member 48 in a first predetermined state M1 is configured to be guided by the guiding section 94 (as shown in FIG. 7), such that the engaging member 48 is moved (such as rotated) to switch to a second predetermined state M2, and the first elastic member 33 is in a state of accumulating a predetermined elastic force F (as shown in FIG. 8). When the third rail 26 is located at the third predetermined position P3 relative to the first rail 22, the first elastic member 33 is configured to release the predetermined elastic force F to move the engaging member 48 to switch to the first predetermined state M1 to be engaged with the auxiliary structure 30 through the engaging part 58, so as to prevent the third rail 26 from being moved from the third predetermined position P3 along the opening direction D1. In such state, the slide rail assembly 20 has a second predetermined length K2 (as shown in FIG. 9) smaller than the first predetermined length K1. Therefore, it is helpful for the user to detach the second rail 24 from the third rail 26 along the opening direction D1 when the slide rail assembly 20 is applied in the narrow space. Specifically, the second predetermined length K2 is defined between the first end part 24*a* of the second rail 24 and the second end part 22*b* of the first rail 22.

Preferably, when the third rail 26 is located at the third predetermined position P3 relative to the first rail 22, the engaging part 58 of the engaging member 48 is located within a predetermined space to be engaged between the first auxiliary part 32 and the second auxiliary part 34, in order to prevent the third rail 26 from being moved along the opening direction D1 or the retracting direction D2.

Figure 10:
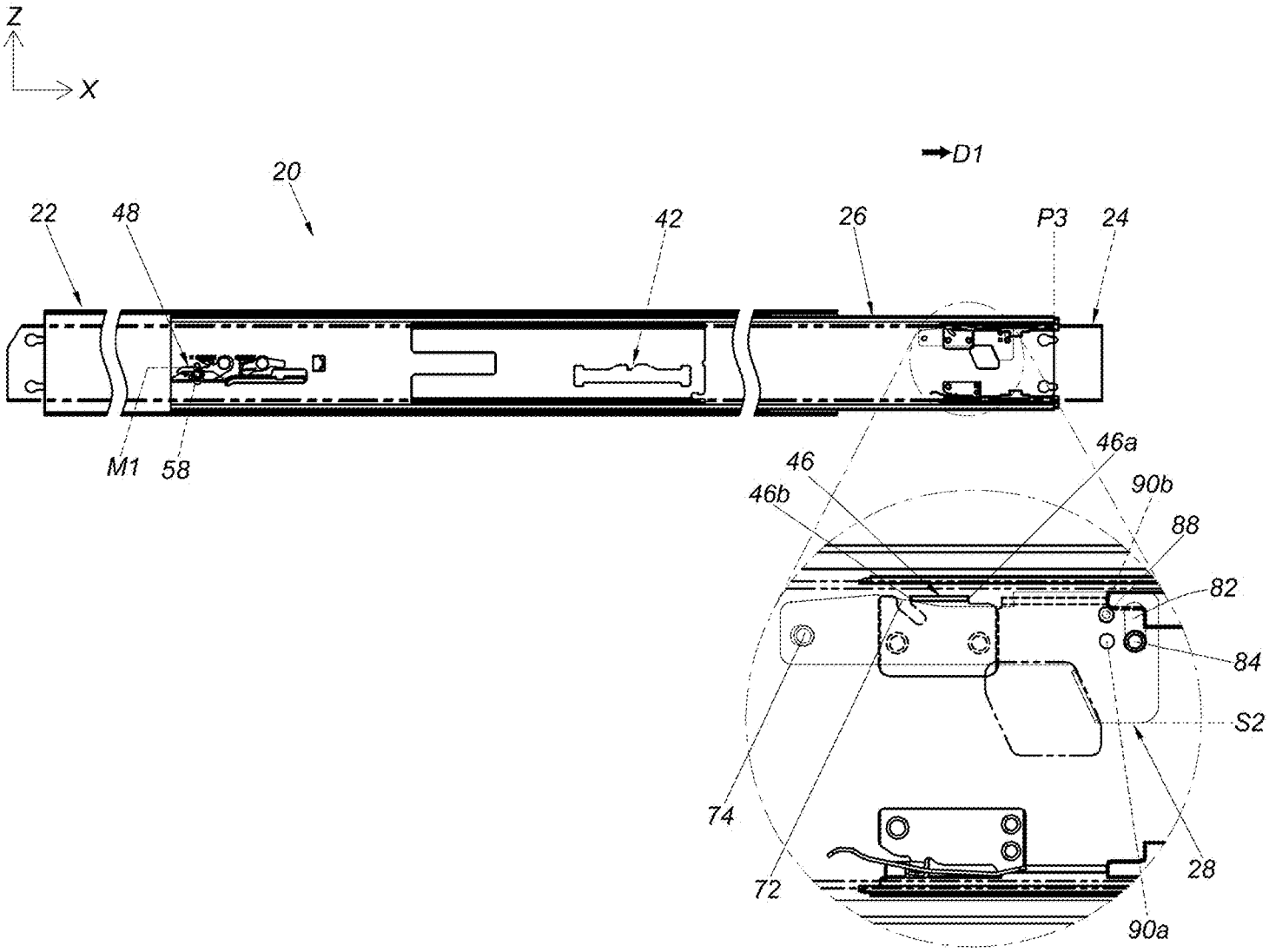
FIG. 10 is a diagram showing the second rail being moved relative to the third rail and the first rail along an opening direction according to the embodiment of the present invention.
Figure 11:
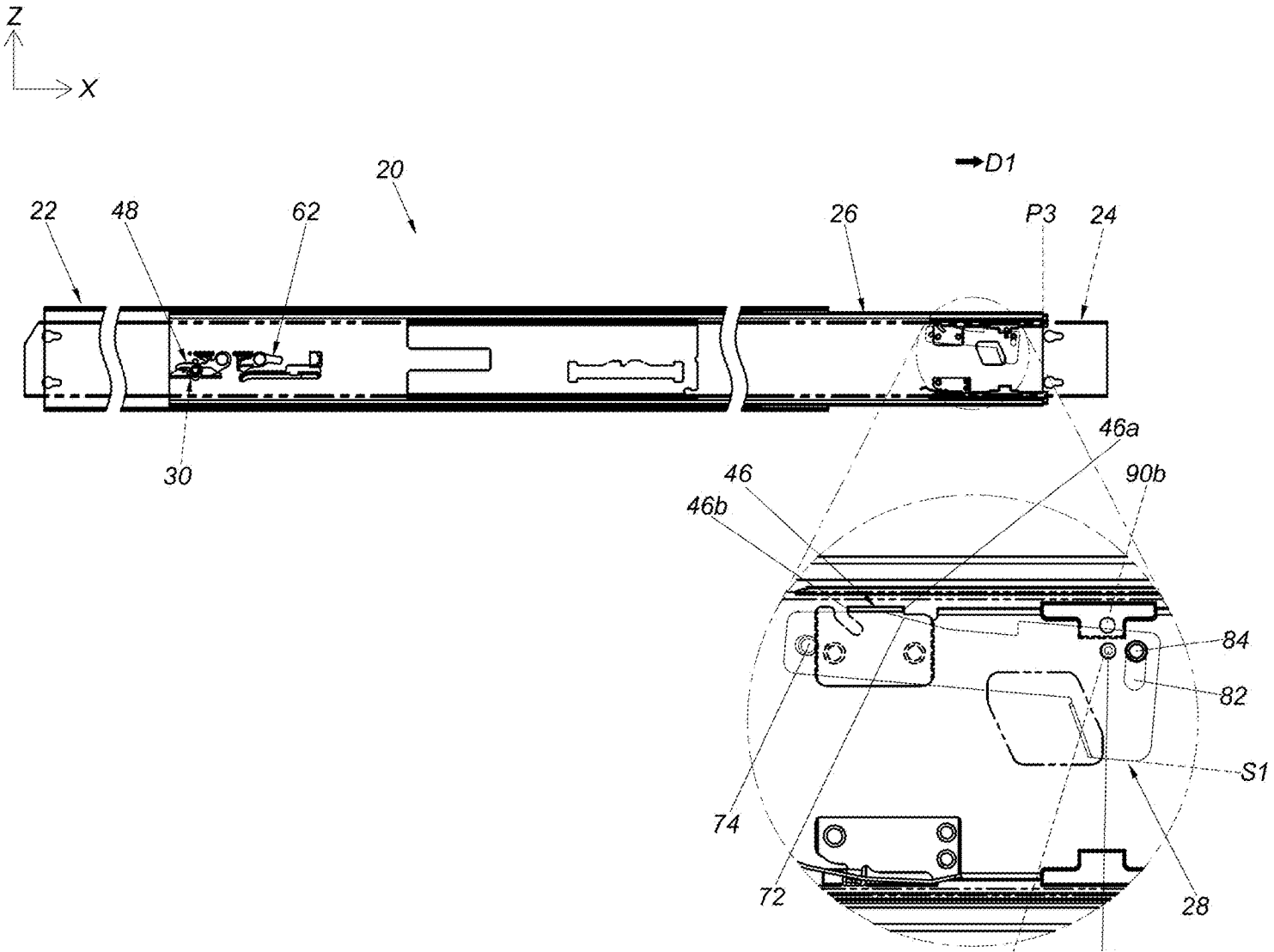
FIG. 11 is a diagram showing the second rail being further moved relative to the third rail and the first rail along the opening direction according to the embodiment of the present invention.
Figure 12:
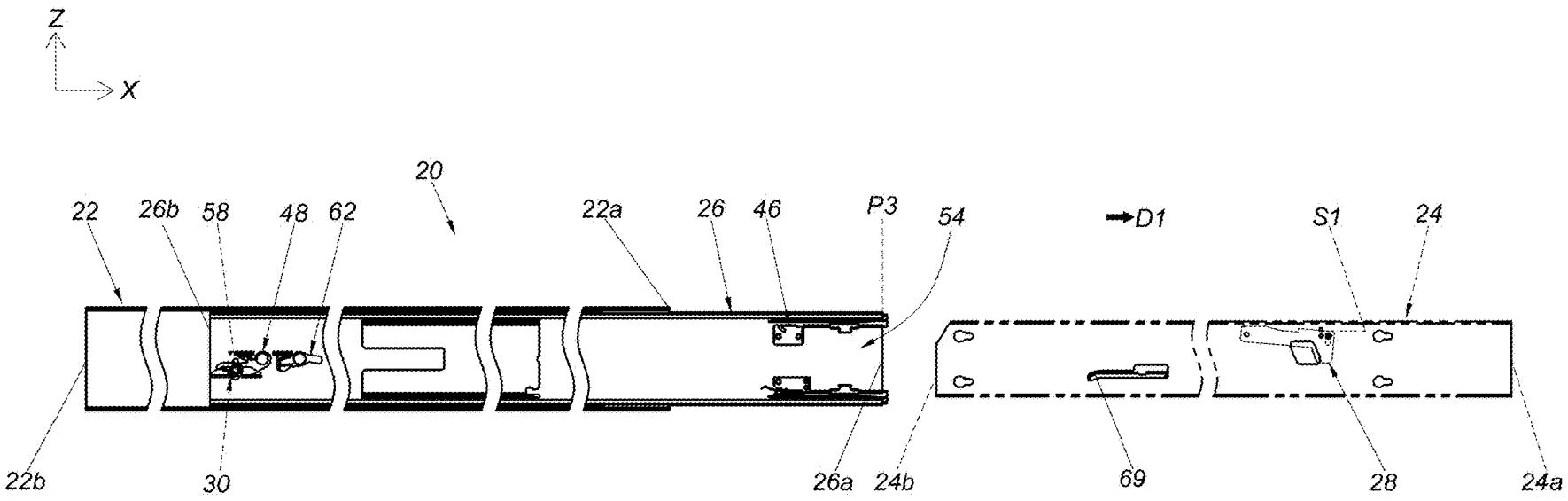
FIG. 12 is a diagram showing the second rail being detached from the third rail on the first rail along the opening direction according to the embodiment of the present invention.

As shown in FIG. 10 to FIG. 12, during a process of the second rail 24 being moved along the opening direction D1 relative to the third rail 26 located at the third predetermined position P3, the second contact part 72 of the switching member 28 and the second predetermined section 46*b* of the predetermined part 46 are configured to abut against each other to generate a predetermined acting force, in order to drive the switching member 28 to return to the first state S1 (shown in FIG. 11) from the second state S2 (shown in FIG. 10). Moreover, the second rail 24 can be further moved relative to the third rail 26 located at the third predetermined position P3 along the opening direction D1 to be detached from the third rail 26 (as shown in FIG. 12).

Therefore, when the slide rail assembly 20 is applied in the narrow space, the length of the slide rail assembly 20 can be shortened by retracting the third rail 26 to the third predetermined position P3, in order to allow the second rail 24 to be easily detached from the second passage 54 of the third rail 26 along the opening direction D1.

Preferably, one of the second contact part 72 of the switching member 28 and the second predetermined section 46*b* of the predetermined part 46 has a guiding structure, and the guiding structure has an inclined surface or an arc surface. In the present embodiment, the second contact part 72 of the switching member 28 has the guiding structure, but the present invention is not limited thereto. As such, when the second contact part 72 of the switching member 28 and the second predetermined section 46*b* of the predetermined part 46 are configured to abut against each other, the switching member 28 is configured to be driven to return to the first state S1 (shown in FIG. 11) from the second state S2 (shown in FIG. 10) easily.

Figure 13:
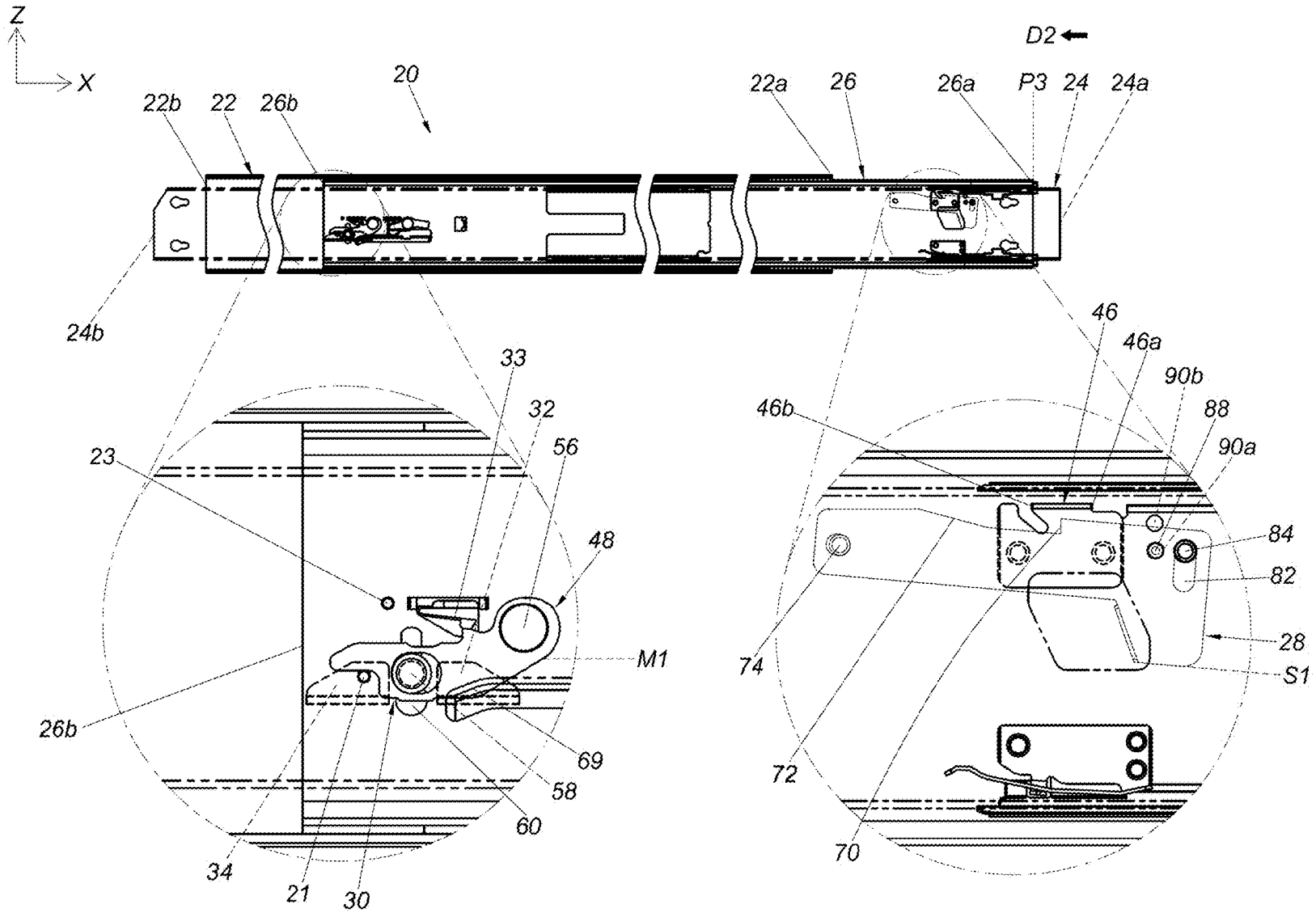
FIG. 13 is a diagram showing the second rail being reinserted into a passage of the third rail on the first rail along the retracting direction according to the embodiment of the present invention.
Figure 14:
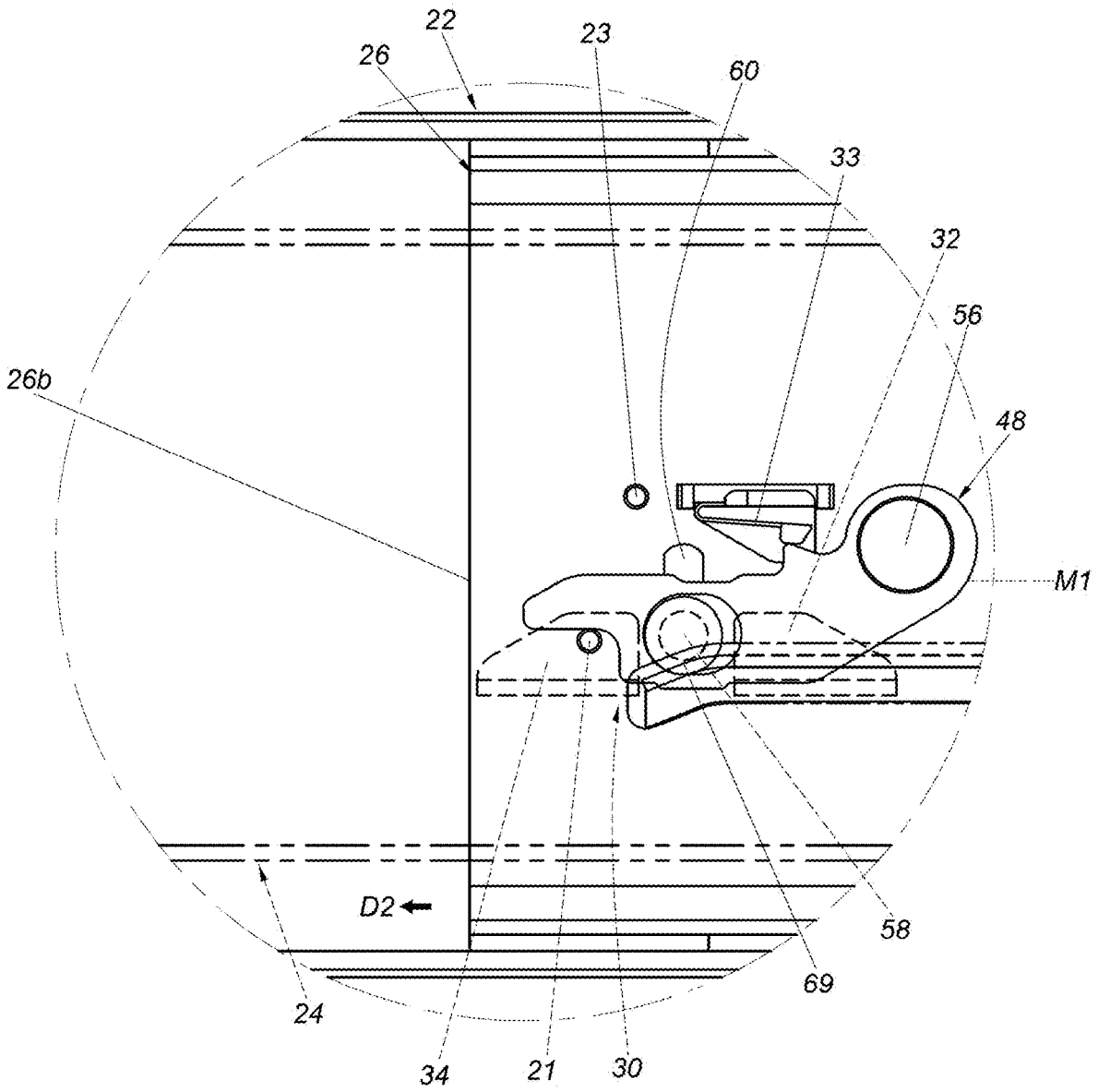
FIG. 14 is a partial enlarged view of the second rail being further inserted into the passage of the third rail on the first rail along the retracting direction according to the embodiment of the present invention.

As shown in FIG. 13 and FIG. 14, when the second rail 24 is reinserted into the second passage 54 of the third rail 26 from outside of the second passage 54 of the third rail 26 along the retracting direction D2, the first contact part 70 of the switching member 28 is not aligned with the predetermined part 46 along the longitudinal direction since the switching member 28 has returned to the first state S1. Therefore, the first contact part 70 of the switching member 28 and the first predetermined section 46*a* of the predetermined part 46 do not block each other (as shown in FIG. 13). In other words, the first contact part 70 of the switching member 28 can directly pass by the first predetermined section 46*a* of the predetermined part 46 along the retracting direction D2, such that the second rail 24 can be further moved relative to the third rail 26 along the retracting direction D2, and the second rail 24 is configured to contact the engaging part 58 of the engaging member 48 through the predetermined feature 69 (as shown in FIG. 14), in order to drive the engaging member 48 to move to be away from the first predetermined state M1. Therefore, the engaging part 58 of the engaging member 48 is no longer engaged between the first auxiliary part 32 and the second auxiliary part 34 of the auxiliary structure 30, such that the third rail 26 can be moved from the third predetermined position P3 along the retracting direction D2 relative to the first rail 22 to a fully retracted position. In other words, the slide rail assembly 20 can be in a fully retracted state.

Therefore, the slide rail assembly 20 according to the embodiment of the present invention has the following technical features:

1. The switching member of the prior art is required to be directly manually operated by the user to return to the first switching position from the second switching position. In contrast to the prior art, during the process of the second rail 24 being moved along the opening direction D1 relative to the third rail 26 located at the third predetermined position P3 according to the embodiment of the present invention, the second contact part 72 of the switching member 28 and the second predetermined section 46*b* of the predetermined part 46 are configured to abut against each other in order to move the switching member 28 to switch from the second state S2 to the first state S1. In other words, the switching member 28 can be driven to return to the first state S1 from the second state S2 without the switching member 28 being manually operated by the user. Therefore, it is more convenient for the user to maintain the slide rail (a carried object) or related equipment.
2. When the second rail 24 is reinserted into the second passage 54 of the third rail 26 from the outside of the second passage 54 of the third rail 26 along the retracting direction D2, the first contact part 70 of the switching member 28 is not aligned with the predetermined part 46 along the longitudinal direction since the switching member 28 has returned to the first state S1. Therefore, the first contact part 70 of the switching member 28 and the first predetermined section 46*a* of the predetermined part 46 do not block each other (as shown in FIG. 13). In other words, the first contact part 70 of the switching member 28 can directly pass by the first predetermined section 46*a* of the predetermined part 46 along the retracting direction D2, such that the second rail 24 can be further moved relative to the third rail 26 along the retracting direction D2.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A slide rail assembly, comprising:

a first rail arranged with an auxiliary structure;

a second rail;

a third rail movably mounted between the first rail and the second rail and arranged with a predetermined part and an engaging member, the predetermined part having a first predetermined section and a second predetermined section opposite to each other; and a switching member movably mounted on the second rail and comprising a first contact part and a second contact part;

wherein when the third rail is located at a first predetermined position relative to the first rail and the second rail is located at a second predetermined position relative to the third rail, the slide rail assembly has a first predetermined length;

wherein during a process of the switching member being moved to switch from a first state to a second state with the second rail being moved from the second predetermined position along a retracting direction, the first contact part of the switching member in the second state and the first predetermined section of the predetermined part are configured to abut against each other, such that the second rail is configured to drive the third rail to move along the retracting direction to a third predetermined position; wherein when the first contact part of the switching member in the second state and the first predetermined section of the predetermined part abut against each other, the second contact part of the switching member is adjacent to the second predetermined section of the predetermined part, and the second contact part of the switching member is extended beyond the second predetermined section of the predetermined part along the retracting direction, such that the predetermined part is located between the first contact part and the second contact part of the switching member;

wherein when the third rail is located at the third predetermined position relative to the first rail, the engaging member is configured to be engaged with the auxiliary structure in order to prevent the third rail from being moved along an opening direction, and the slide rail assembly has a second predetermined length shorter than the first predetermined length;

wherein during a process of the second rail being moved along the opening direction relative to the third rail located at the third predetermined position, the second contact part of the switching member and the second predetermined section of the predetermined part are configured to abut against each other in order to drive the switching member to return from the second state to the first state.

2. The slide rail assembly of claim 1, wherein one of the second contact part of the switching member and the second predetermined section of the predetermined part has a guiding structure.

3. The slide rail assembly of claim 2, wherein the guiding structure has an inclined surface or an arc surface.

4. The slide rail assembly of claim 1, wherein the switching member is pivotally connected to the second rail through a shaft member.

5. The slide rail assembly of claim 4, wherein the switching member comprises a first part, a second part and an extension part connected between the first part and the second part; wherein the first part is pivotally connected to the second rail through the shaft member, and the extension part comprises the first contact part and the second contact part.

6. The slide rail assembly of claim 5, wherein one of the second part of the switching member and the second rail is arranged with a first limiting feature, and the other one of the second part of the switching member and the second rail is arranged with a second limiting feature.

7. The slide rail assembly of claim 6, wherein one of the first limiting feature and the second limiting feature is formed with a limiting space, and the other one of the first limiting feature and the second limiting feature is a protrusion part passing through a portion of the limiting space.

8. The slide rail assembly of claim 1, wherein one of the switching member and the second rail comprises a holding feature, and the other one of the switching member and the second rail comprises a corresponding feature; wherein when the switching member is in the second state, the holding feature is configured to be detachably engaged with the corresponding feature in order to hold the switching member in the second state.

9. The slide rail assembly of claim 1, wherein the auxiliary structure comprises a first auxiliary part and a second auxiliary part; wherein when the third rail is located at the third predetermined position relative to the first rail, the engaging member is configured to be engaged between the first auxiliary part and the second auxiliary part in order to prevent the third rail from being moved along the opening direction or the retracting direction.

10. The slide rail assembly of claim 1, wherein the first rail has a first end part and a second end part opposite to each other; wherein the auxiliary structure is arranged adjacent to the second end part, and the first rail is further arranged with a blocking structure adjacent to the first end part.

11. The slide rail assembly of claim 10, wherein the third rail is further arranged with a blocking member; wherein when the third rail is located at the first predetermined position relative to the first rail, the blocking member and the blocking structure are configured to block each other in order to prevent the third rail from being moved relative to the first rail from the first predetermined position along the retracting direction; wherein during a process of the second rail being moved from the second predetermined position along the retracting direction, a predetermined feature of the second rail is configured to drive the blocking member to move, such that the blocking member and the blocking structure no longer block each other.

12. A slide rail assembly, comprising:

a first rail;

a second rail longitudinally movable relative to the first rail;

a third rail movably mounted between the first rail and the second rail and arranged with a predetermined part, the predetermined part having a first predetermined section and a second predetermined section opposite to each other; and a switching member movably mounted on the second rail and configured to be in one of a first state and a second state, the switching member comprising a first contact part and a second contact part;

wherein when the switching member is in the first state, the first contact part of the switching member is not aligned with the predetermined part along a longitudinal direction of the slide rail assembly; when the switching member is in the second state, the first contact part of the switching member is aligned with the predetermined part along the longitudinal direction;

wherein when the slide rail assembly is in an extended state, the third rail is located at a first predetermined position relative to the first rail, and the second rail is located at a second predetermined position relative to the third rail;

wherein during a process of the second rail being moved from the second predetermined position along a retracting direction with the switching member being in the second state, the first contact part of the switching member in the second state and the first predetermined section of the predetermined part are configured to abut against each other, such that the second rail is configured to drive the third rail to move along the retracting direction to a third predetermined position; wherein when the first contact part of the switching member in the second state and the first predetermined section of the predetermined part abut against each other, the second contact part of the switching member is adjacent to the second predetermined section of the predetermined part, and the second contact part of the switching member is extended beyond the second predetermined section of the predetermined part along the retracting direction, such that the predetermined part is located between the first contact part and the second contact part of the switching member;

wherein during a process of the second rail being moved along an opening direction relative to the third rail located at the third predetermined position, the second contact part of the switching member and the second predetermined section of the predetermined part are configured to abut against each other in order to move the switching member to switch from the second state to the first state.

13. The slide rail assembly of claim 12, wherein the first rail is further arranged with an auxiliary structure, and the third rail is further arranged with an engaging member; wherein when the third rail is located at the third predetermined position relative to the first rail, the engaging member is configured to be engaged with the auxiliary structure in order to prevent the third rail from being moved along the opening direction.

14. The slide rail assembly of claim 13, wherein one of the second contact part of the switching member and the second predetermined section of the predetermined part is formed with a guiding structure.

15. The slide rail assembly of claim 13, one of the switching member and the second rail comprises a holding feature, and the other one of the switching member and the second rail comprises a corresponding feature; wherein when the switching member is in the second state, the holding feature is configured to be detachably engaged with the corresponding feature in order to hold the switching member in the second state.

16. The slide rail assembly of claim 13, wherein the auxiliary structure comprises a first auxiliary part and a second auxiliary part; wherein when the third rail is located at the third predetermined position relative to the first rail, the engaging member is configured to be engaged between the first auxiliary part and the second auxiliary part in order to prevent the third rail from being moved along the opening direction or the retracting direction.

17. The slide rail assembly of claim 13, wherein the first rail has a first end part and a second end part opposite to each other; wherein the auxiliary structure is arranged adjacent to the second end part, and the first rail is further arranged with a blocking structure adjacent to the first end part.

18. The slide rail assembly of claim 17, wherein the third rail is further arranged with a blocking member; wherein when the third rail is located at the first predetermined position relative to the first rail, the blocking member and the blocking structure are configured to block each other in order to prevent the third rail from being moved relative to the first rail from the first predetermined position along the retracting direction.

19. The slide rail assembly of claim 18, wherein during a process of the second rail being moved from the second predetermined position along the retracting direction, a predetermined feature of the second rail is configured to drive the blocking member to move, such that the blocking member and the blocking structure no longer block each other.

* * * * *